US006468411B1

(12) United States Patent
Eckles et al.

(10) Patent No.: US 6,468,411 B1
(45) Date of Patent: Oct. 22, 2002

(54) BRIGHTENER FOR ZINC-NICKEL PLATING BATH AND METHOD OF ELECTROPLATING

(75) Inventors: William E. Eckles, Cleveland Heights, OH (US); Becki A. Zinni-Kettering, Middleburg Heights, OH (US); Robert E. Frischauf, Lakewood, OH (US)

(73) Assignee: Taskem Inc., Brooklyn Heights, OH (US)

( * ) Notice: Subject to any disclaimer, the term of this patent is extended or adjusted under 35 U.S.C. 154(b) by 0 days.

(21) Appl. No.: 09/903,207

(22) Filed: Jul. 11, 2001

(51) Int. Cl.[7] ..... C25D 3/56
(52) U.S. Cl. ..... 205/246; 205/310
(58) Field of Search ..... 205/244, 245, 205/246, 259, 309, 310

(56) References Cited

U.S. PATENT DOCUMENTS

| | | | | |
|---|---|---|---|---|
| 3,681,211 A | | 8/1972 | Schwartz et al. | |
| 3,734,839 A | | 5/1973 | Hoyer et al. | |
| 3,769,184 A | * | 10/1973 | Rushmere | 204/55 R |
| 3,919,056 A | * | 11/1975 | Habulak | 204/55 R |
| 3,953,304 A | | 4/1976 | Allan et al. | |
| 3,993,548 A | | 11/1976 | Creutz et al. | |
| 4,062,739 A | | 12/1977 | James et al. | |
| 4,071,418 A | | 1/1978 | James | |
| 4,071,419 A | | 1/1978 | James | |
| 4,146,442 A | | 3/1979 | McFarland | |
| 4,210,500 A | | 7/1980 | Bishop | |
| 4,222,829 A | | 9/1980 | Popescu | |
| 4,730,022 A | | 3/1988 | Willis | |
| 4,861,442 A | * | 8/1989 | Nishihama et al. | 204/44.2 |
| 4,877,496 A | | 10/1989 | Yanagawa et al. | |
| 4,889,602 A | | 12/1989 | Oshima et al. | |
| 5,405,523 A | | 4/1995 | Eckles | |
| 5,417,840 A | | 5/1995 | Block et al. | |

FOREIGN PATENT DOCUMENTS

| | | |
|---|---|---|
| JP | 401298192 | 12/1989 |

* cited by examiner

*Primary Examiner*—Nam Nguyen
*Assistant Examiner*—William T. Leader
(74) *Attorney, Agent, or Firm*—Tarolli, Sundheim, Covell, Tummino & Szabo L.L.P.

(57) ABSTRACT

An alkaline zinc-nickel electroplating bath comprises zinc ions, nickel ions, a primary brightener which is an N-methylpyridinium compound substituted at the 3-position of the pyridine ring with a carboxylate group or a group hydrolyzable to a carboxylate group and a secondary brightener which is an aliphatic amine. An example of a preferred brightener is N-methylpyridinium-3-carboxylate or a salt thereof. A preferred polyamine is a polyethyleimine. By the present invention, a mirror bright zinc-nickel deposit can be obtained having more than 4% by weight nickel, without blistering or decomposition of the primary brightener.

7 Claims, No Drawings

BRIGHTENER FOR ZINC-NICKEL PLATING BATH AND METHOD OF ELECTROPLATING

BACKGROUND OF THE INVENTION

1. Technical Field

The present invention relates to a zinc-nickel plating bath.

2. Description of the Prior Art

JP 1298192A discloses an alkaline cyanide-free zinc nickel plating solution having a pH greater than 13. The plating solution contains 5–20 g/L $Zn^{2+}$, 0.4–4.0 g/L $Ni^{2+}$, 0.04 mol/L of one or more amine chelating agents selected from N-aminoethylethanolamine, ethylenediamine, diethylenetriamine, triethylenetetramine, tetraethylenepentamine, and pentaethylenehexamine, and an effective amount of a brightener, such as a quaternary pyridine compound.

U.S. Pat. No. 5,405,523 discloses a zinc alloy electroplating bath comprising a ureylene quaternary ammonium polymer as a brightening agent. The bath can also contain a supplemental brightener. One suitable supplemental brightener which is listed is n-benzyl nicotinic acid (sodium salt). Nickel is listed as a metal which can be alloyed with the zinc.

U.S. Pat. No. 4,889,602 discloses an alkaline zinc-nickel electroplating bath which comprises an aliphatic amine or polymer of an aliphatic amine in combination with an hydroxyaliphatic carboxylic acid.

U.S. Pat. Nos. 4,071,418 and 4,071,419 disclose the combination of amines with substituted pyridines such as nicotinic acid or nicotinamide for a zinc bath.

U.S. Pat. No. 5,417,840 discloses an alkaline zinc-nickel plating bath comprising a polyamine such as polyethyleneimine in combination with an aromatic heterocyclic nitrogen containing compound such as a sulfo-betaine, e.g., pyridinium-N-propane-3-sulfonic acid; or a pyridinium chloride such as N-carboxymethyl pyridinium chloride.

U.S. Pat. Nos. 4,730,022 and 4,210,500 disclose the use of an aromatic carboxyl compound such as 1-benzylpyridinium-3-carboxylate or 3-pyridine carboxylic acid (nicotinic acid) as a supplementary brightener in an alkaline zinc bath. The carboxyl compounds are used in combination with a primary brightener, such as the reaction product of a polyamine and a sulfonate.

SUMMARY OF THE INVENTION

The present invention resides in an alkaline zinc-nickel electroplating bath that comprises zinc ions, nickel ions, a primary brightener, which is an N-methylpyridinium compound substituted at the 3-position of the pyridine ring with a carboxylate group or a group which is hydrolyzable to a carboxylate group, and a secondary brightener, which is an aliphatic amine. Examples of hydrolyzable groups at the 3-position are carboxamides, carboxylate esters, and nitrites. An example of a preferred primary brightener is N-methylpyridinium-3-carboxylate (or a salt thereof, e.g., sodium or potassium salt thereof).

A preferred aliphatic amine is a polyethyleneimine.

Preferably, the electroplating bath has a pH more than about 13.

DESCRIPTION OF PREFERRED EMBODIMENTS OF THE INVENTION

The electroplating bath of the present invention is an aqueous alkaline bath having a pH that is preferably above about 13, and more preferably, above about 14. The bath contains an inorganic alkaline component in an effective amount to achieve this pH. Amounts of from about 50 grams per liter to about 200 grams per liter, based on the electroplating bath, of the alkaline component can be used. Examples of suitable alkaline components are alkali metal derivatives such as sodium hydroxide and potassium hydroxide.

The electroplating bath contains a controlled amount of zinc ions and a controlled amount of nickel ions. The source for the zinc ions for the electroplating bath can be any zinc compound which is soluble in an alkaline aqueous medium. Examples of zinc compounds which can be added to the electroplating bath are zinc oxide, or a soluble salt such as zinc sulfate, zinc carbonate, zinc sulfamate, and zinc acetate. The concentration of zinc ions in the electroplating bath is from about 1 to about 100 grams per liter, preferably about 4 to about 50 grams per liter (about 4,000 to about 50,000 ppm). At a pH above about 13, the predominant zinc species in the bath is the zincate ion.

The source for the nickel ions for the electroplating bath can be any nickel compound which can be made soluble in an aqueous alkaline solution. Examples of suitable nickel compounds are an inorganic or organic acid salt of nickel, such as nickel sulfate, nickel carbonate, nickel acetate, nickel sulfamate and nickel formate. The concentration of nickel ions in the electroplating bath can be from about 0.1 to about 10 grams per liter, (about 100 to about 10,000 ppm), more preferably in the range from about 0.1 gram per liter to about 3 grams per liter (about 100 ppm to about 3,000 ppm).

The electroplating bath of the present invention comprises a combination of brighteners.

The primary brightener in the bath is an N-methyl pyridinium compound that has the following structural formula:

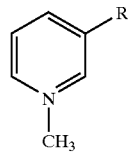

in which R is a carboxylate group or a group that can undergo alkaline hydrolysis to a carboxylate group. For purposes of the present application, the term "N-methylpyridinium compound" is also meant to include salts of the N-methylpyridinium compound such as sodium or potassium salts of the N-methylpyridinium compound.

Examples of groups that are hydrolyzable to a carboxylate group are carboxamides, carboxylate esters and nitrites. Carboxylate esters of N-methylnicotinic acid which are useful as esters react with hydroxyl ions to form the carboxylate group. Nitriles hydrolyze to amides and then to carboxylates and are also useful.

A preferred primary brightener in the electroplating bath of the present invention is N-methylpyridinium-3-carboxylate (or salt thereof). This compound is commonly known as trigonelline or N-methylnicotinate and has a carboxylate group at the 3-position of the pyridine ring as shown below:

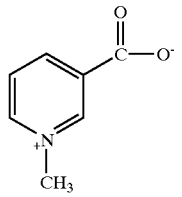

One method of preparing N-methylpyridinium-3-carboxylate involves reacting nicotinic acid ($C_5H_4NCOOH$) with sodium hydroxide in an aqueous solution to produce sodium nicotinate. The sodium nicotinate is reacted with methyl iodide to produce the N-methylpyridinium-3-carboxylate. The reaction mixture is then diluted to about a 10% by weight solution. Other methods of preparing N-methylpyridinium-3-carboxylate are well known in the art and can be used to prepare the N-methylpyridinium-3-carboxylate of the present invention.

The primary brightener in the electroplating bath of the present invention is present preferably in an amount in the range of about 0.01 to about 1 gram per liter (about 10 ppm to about 1,000 ppm).

The electroplating bath of the present invention also comprises a secondary brightener. The secondary brightener in the bath is an aliphatic amine. A preferred aliphatic amine is an aliphatic polyamine. The molecular weight of the aliphatic polyamine is not critical and can be the molecular weight of any aliphatic polyamine that is commercially available.

Preferred aliphatic amines, which can be used as a secondary brightener, are aliphatic polyamines derived from ethyleneimine (aziridine). Preferred aliphatic polyamines derived from ethyleneimine are tetraethylenepentamine (TEPA) and diethylenetetramine. Another preferred aliphatic polyamine derived from ethyleneimine is a polyethyleneimine marketed by BASF Corporation of Parsippany, N.J. under the trademark POLYMIN G-35. POLYMIN G-35 is a polyethyleneimine that has the general formula $(C_2H_5N)_n$ and a molecular weight of about 3500.

In the electroplating bath of the present invention, the aliphatic amine performs a dual function. In addition to functioning as a secondary brightener, the aliphatic amine also serves as a complexing agent for the nickel ions. Nickel is non-amphoteric, and at a high pH, forms nickel hydroxide, which is insoluble and precipitates out of solution. To prevent precipitation of nickel hydroxide, a complexing agent is added to the bath, which complexes the nickel ions and prevents the formation of the nickel hydroxide. In a preferred embodiment of the present invention, the complexing agent is the aliphatic amine of the present invention.

With the use of the brighteners of the present invention in the electroplating bath of the present invention, not only is a bright deposit obtained, but also one having a relatively high nickel content, at least about 4% by weight, and preferably above about 10% by weight.

A primary application for the zinc-nickel electroplating bath of the present invention is to provide a base plate for automotive components exposed to severe corrosion. Typically, the components are treated with a chromate conversion coating. It is known that a relatively high nickel content in the zinc-nickel plate, preferably in the range of about 10% to about 16% by weight nickel, provides improved resistance to corrosion and a better appearance with such a coating.

Using the combination of N-methylpyridinium compound of the present invention with an aliphatic amine resulted in bright deposits that were resistant to blistering and that had nickel in the desired concentration range above about 4% by weight, and preferably above about 10% by weight, e.g., 12% nickel and 88% zinc.

The amount of aliphatic amine that is used in the zinc-nickel electroplating bath is within the range of about 2.5 to about 60 grams per liter of bath (2,500 to 60,000 ppm).

The bath of the present invention can also comprise a hydroxyl amine such as triethanolamine as an auxiliary brightener.

The electroplating baths of the present invention are used at conventional current densities, about 1 to about 100 amperes per square foot as determined by Hull Cell evaluation. Bright deposits are obtained at conventional temperatures, for instance about 20° C. to about 40° C.

The following example illustrates the present invention.

EXAMPLE 1

The following alkaline electroplating bath was prepared:

| INGREDIENT | AMOUNT BASED ON BATH |
|---|---|
| Zinc | 10 grams per liter |
| Nickel | 1.5 grams per liter |
| Sodium hydroxide | 75 grams per liter |
| POLYMIN G-35 | 30 grams per liter |
| Triethanolamine | 20 grams per liter |
| Trigonelline (N-methyl-pyridinium-3-carboxylate) | 0.28 grams per liter (2 millimoles per liter) |

"POLYMIN G-35" is the tradename of a polyethyleneimine marketed by BASF Corporation, of Parsippany, N.J. The amount of trigonelline added to the bath (i.e., 0.28 grams per liter) was that amount effective to provide the bath with a trigonelline concentration of about 2 millimoles per liter. This concentration was calculated using the molecular weight of the zwitterion of trigonelline, which is the form that trigonelline exists in the bath.

The bath was added to a 267 milliliter Hull cell. A steel Hull cell panel was plated at two amperes for thirty minutes. The current density varied at different areas of the Hull Cell panel, from a low at some areas of about 1 ampere per square foot to a high at other areas of about 100 amperes per square foot. This plating produced a zinc-nickel deposit which was mirror bright and contained about 12% by weight nickel.

The zinc-nickel deposit was level across the surface of the Hull cell panel and showed no evidence of blistering during the electroplating process. Moreover, after being removed from the electroplating bath for at least one month, the zinc-nickel deposit, upon visual inspection, showed no evidence of blistering.

The concentration of trigonelline was measured immediately after mixing and after five days standing using high-pressure liquid chromatography (HPLC). The purpose of the two HPLC measurements was to determine the resistance of the brightener to decomposition by reaction with hydroxyl ions in the bath. There was no change in the concentration of trigonelline after five days indicating that the trigonelline brightener had excellent resistance to decomposition by reaction with hydroxyl ions in the bath.

Comparative Example 1

The following comparative alkaline electroplating bath was prepared. The bath of this comparative example had the same ingredients at the same concentrations as the bath in Example 1 except that sulfopropylpyridinium hydroxide (a commonly used brightener for zinc nickel plating baths) was used as the brightener instead of trigonelline. The amount of sulfopropylpyridinium hydroxide added to the bath (i.e., 0.40 grams per liter) was that amount effective to provide the bath with a sulfopropylpyridinium hydroxide concentration of about 2 millimoles per liter. This concentration was calculated using the molecular weight of the zwitterion of sulfopropylpyridinium hydroxide, which is the form that sulfopropylpyridinium hydroxide exists in the bath.

| INGREDIENT | AMOUNT BASED ON BATH |
|---|---|
| Zinc | 10 grams per liter |
| Nickel | 1.5 grams per liter |
| Sodium hydroxide | 75 grams per liter |
| POLYMIN G-35 | 30 grams per liter |
| Triethanolamine | 20 grams per liter |
| Sulfopropylpyridinium Hydroxide | 0.40 grams per liter (2 millimoles per liter) |

The bath was added to a 267 milliliter Hull cell. A steel Hull cell panel was plated at two amperes for thirty minutes. The current density varied at different areas of the Hull Cell panel, from a low at some areas of about 1 ampere per square foot to a high at other areas of about 100 amperes per square per foot. This plating produced a zinc-nickel deposit which was bright and contained about 12% by weight nickel. The zinc-nickel deposit, however, blistered during the electroplating process at areas of the steel Hull Cell panel where the current density was above 80 amps per square foot.

Comparative Example 2

The following comparative alkaline electroplating bath was prepared. The bath of this comparative example had the same ingredients at the same concentrations as the bath in Example 1 except that 1-benzylnicotinate was used as the brightener instead of trigonelline. The amount of 1-benzylnicotinate added to the bath (i.e., 0.42 grams per liter) was that amount effective to provide the bath with a 1-benzylnicotinate concentration of about 2 millimoles per liter. This concentration was calculated using the molecular weight of the zwitterion of 1-benzylnicotinate, which is the form that 1-benzylnicotinate exists in the bath.

| INGREDIENT | AMOUNT BASED ON BATH |
|---|---|
| Zinc | 10 grams per liter |
| Nickel | 1.5 grams per liter |
| Sodium hydroxide | 75 grams per liter |
| POLYMIN G-35 | 30 grams per liter |
| Triethanolamine | 20 grams per liter |
| 1-benzylnicotinate | 0.42 grams per liter (2 millimoles per liter) |

The bath was added to a 267 milliliter Hull cell. A steel Hull cell panel was plated at two amperes for thirty minutes. The current density varied at different areas of the Hull Cell panel, from a low at some areas of about 1 ampere per square foot to a high at other areas of about 100 amperes per square foot. This plating produced a zinc-nickel deposit which was bright and contained about 12% by weight nickel. The zinc-nickel deposit, however, blistered during the electroplating process at areas of the steel Hull Cell panel where the current density was above 80 amps per square foot.

Additionally, the concentration of 1-benzylnicotinate in the bath of Comparative Example 2 was measured, using high-pressure liquid chromatography (HPLC), immediately after mixing the bath and after letting the bath stand for five days in order to determine the resistance of the brightener to decomposition by reaction with hydroxyl ions in the bath. After five days, the HPLC measurement indicated that the concentration of 1-benzylnicotinoate in the bath of Comparative Example 2 decreased by 90%.

Advantages of the present invention should now be apparent. The electroplating bath of the present invention produces mirror-bright deposits that have a nickel content of 12% or more. Trigonelline is superior to sulfopropylpyridinium hydroxide because at an equal molar concentration deposits plated from the bath with trigonelline are brighter than with sulfopropylpyridinium hydroxide. Moreover, deposits plated from the bath with trigonelline showed no evidence of blistering after being removed from the bath for one month. In contrast, deposits plated from the bath with sulfopropylpyridinium hydroxide blistered right out of the bath.

Trigonelline is superior to 1-benzylnicotinate because deposits plated from the bath containing 1-benzylnicotinate blistered and 1-benzylnicotinate are not stable in this highly alkaline solution, while trigonelline is stable.

From the above description of the invention, those skilled in the art will perceive improvements, changes and modifications. Such improvements, changes and modifications within the skill of the art are intended to be covered by the appended claims.

Having described the invention, the following is claimed:

1. An alkaline zinc-nickel electroplating bath comprising zinc ions, nickel ions, a primary brightener which is an N-methylpyridinium compound substituted at the 3-position of the pyridine ring with a carboxylate group or a group hydrolyzable to a carboxylate group, and a secondary brightener which is an aliphatic amine.

2. The bath of claim 1 wherein said primary brightener comprises N-methylpyridinium-3-carboxylate or salt thereof.

3. The bath of claim 2 wherein said aliphatic amine is a polyethyleneimine.

4. The bath of claim 3 producing a deposit comprising more than about 4% by weight nickel.

5. An alkaline zinc-nickel electroplating bath comprising:

(a) about 4 to about 50 grams per liter of zinc;

(b) about 0.1 to about 10 grams per liter of nickel;

(c) about 50 to about 200 grams per liter of alkaline compound effective to provide a pH more than about 13;

(d) about 0.01 to about 1 gram per liter of primary brightener wherein said primary brightener is an N-methylpyridinium compound substituted at the 3-position of the pyridine ring with a carboxylate group or a group hydrolyzable to a carboxylate group; and (e) about 2.5 to about 60 grams per liter of an aliphatic amine.

6. A method for obtaining a zinc-nickel electroplate deposit comprising the steps of:

(a) preparing an aqueous alkaline bath comprising zinc ions, nickel ions, a primary brightener which is an N-methylpyridinium compound substituted at the 3-position of the pyridine ring with a carboxylate group or a group hydrolyzable to a carboxylate group, and a secondary brightener which is an aliphatic amine;

(b) positioning a part to be plated in said bath; and (c) electroplating said part.

7. A method for obtaining a zinc-nickel electroplate deposit comprising the steps of:

(a) preparing an aqueous alkaline bath having a pH more than about 13 and the following composition (i) about 4 to about 50 grams per liter of zinc;

(ii) about 0.1 to about 10 grams per liter of nickel;

(iii) about 50 to about 200 grams per liter of alkaline component effective to provide a pH more than about 13;

(iv) about 0.01 to about 1 gram per liter of primary brightener, wherein said primary brightener is an N-methylpyridinium compound in which a carboxylate group or a group hydrolyzable to a carboxylate group, is at the 3-position of the pyridine ring; and (v) about 2.5 to about 60 grams per liter of an aliphatic amine;

(b) positioning a part to be plated in said bath; and (c) electroplating said part.

* * * * *